US006460493B2

(12) United States Patent
Yang et al.

(10) Patent No.: US 6,460,493 B2
(45) Date of Patent: Oct. 8, 2002

(54) UNIFLOW SCAVENGING MICROENGINE

(75) Inventors: Wei Yang, Minnetonka; Ulrich Bonne, Hopkins, both of MN (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/751,361

(22) Filed: Dec. 28, 2000

(65) Prior Publication Data

US 2002/0083907 A1 Jul. 4, 2002

(51) Int. Cl.[7] ..... F02B 71/00
(52) U.S. Cl. ..... 123/46 R
(58) Field of Search ..... 123/46 R, 46 A, 123/46 B, 46 SC, 46 E, 46 H, 42

(56) References Cited

U.S. PATENT DOCUMENTS

| | | | | |
|---|---|---|---|---|
| 2,678,032 A | | 5/1954 | Mallory | |
| 2,966,148 A | | 12/1960 | Jarret et al. | |
| 3,234,395 A | | 2/1966 | Colgate | |
| 4,154,200 A | | 5/1979 | Jarret et al. | |
| 4,325,331 A | * | 4/1982 | Erickson | 123/42 |
| 4,480,599 A | | 11/1984 | Allais | |
| 4,530,317 A | * | 7/1985 | Schutten | 123/46 R |
| 5,342,176 A | | 8/1994 | Redlich | |
| 5,631,514 A | | 5/1997 | Garcia et al. | |
| 5,791,304 A | | 8/1998 | Taipale | |
| 5,893,343 A | | 4/1999 | Rigazzi | |
| 5,932,940 A | | 8/1999 | Epstein et al. | |
| 6,109,222 A | | 8/2000 | Glezer et al. | |
| 6,119,640 A | | 9/2000 | Zakharov et al. | |
| 6,152,093 A | | 11/2000 | Sawada et al. | |
| 6,276,313 B1 | * | 8/2001 | Yang et al. | 123/46 E |
| 6,293,231 B1 | * | 9/2001 | Valentin | 123/46 R |

FOREIGN PATENT DOCUMENTS

| | | |
|---|---|---|
| WO | WO 94/18433 | 8/1994 |
| WO | WO 99/43936 | 9/1999 |

* cited by examiner

*Primary Examiner*—Gene Mancene
*Assistant Examiner*—Hyder Ali

(57) ABSTRACT

An engine and associated methods are disclosed. An engine in accordance with the present invention comprises a housing defining a cavity and a slidable member disposed in the cavity. The slidable member is preferably configured to form one or more combustion chambers, and the slidable member adapted to slide back and fourth relative to the housing in a cycle. One or more intake ports are provided for selectively providing fuel to the one or more combustion chambers during selected timed during the cycle. One or more exhaust ports are provided for selectively venting exhaust from the one or more combustion chambers during selected times during the cycle. The intake and exhaust ports are preferably disposed so that intake and exhaust flows are in the same direction (e.g. uniflow).

23 Claims, 16 Drawing Sheets

UNIFLOW SCAVENGING MICROENGINE

The Government may have rights in this invention pursuant to Contract No. F30602-99C-0200.

FIELD OF THE INVENTION

The present invention relates generally to internal combustion engines. More particularly, the present invention relates to uniflow scavenging internal combustion engines.

BACKGROUND OF THE INVENTION

An engine may be defined generally as a cyclical device used for power production. Most readers will be familiar with the internal combustion engines that have been widely used in automotive applications. A typical automotive engine includes a plurality of pistons, each residing in a separate cylinder. Each piston is coupled to a crankshaft by a piston rod. The typical automotive engine includes a large number of parts. The large number of parts has an impact on the expense of building or fabricating automotive engines, and on the reliability of the engines (e.g., since there are a large number of parts, the likelihood that one of them will fail is increased.) The large number of parts and complexity of the typical automotive engine also has the effect that this type of engine is typically not applicable to very small (i.e., miniature or micro) applications and not economically feasible.

SUMMARY OF THE INVENTION

The present invention relates generally to internal combustion engines. More particularly, the present invention relates to uniflow scavenging internal combustion engines. An engine in accordance with one embodiment of the present invention comprises a housing defining an elongated cavity. The elongated cavity has a first end, a second end, and internal walls extending therebetween. A fixed piston is located in the cavity and fixedly attached to the housing. The fixed piston has a first end toward the first end of the cavity and a second end toward the second end of the cavity.

A slider is slidably disposed within the cavity. The slider has a first end toward the first end of the cavity and a second end toward the second end of the cavity. The slider further has a central channel for slidably receiving the fixed piston. The central channel has a first end adjacent the first end of the fixed piston and a second end adjacent the second end of the fixed piston. A first combustion chamber is defined by a space between the first end of the channel and the first end of the fixed piston. A second combustion chamber is defined by a space between the second end of the channel and the second end of the fixed piston.

The housing also defines a first intake port and a second intake port. The first intake port is preferably in fluid communication with a first intake space defined by the space between the first end of the slider and the first end of the cavity when the slider is slidably disposed toward the second end of the cavity. The second intake port is preferably in fluid communication with a second intake space defined by the space between the second end of the slider and the second end of the cavity when the slider is slidably disposed toward the first end of the cavity.

The housing also defines a first exhaust port and a second exhaust port. The first exhaust port is preferably in fluid communication with the first combustion chamber when the slider is slidably disposed toward the first end of the cavity. The second exhaust port is preferably in fluid communication with the second combustion chamber when the slider is slidably disposed toward the second end of the cavity.

The housing also defines one or more first intake channels and one or more second intake channels. The first intake channels provide a fluid flow path between the first intake space and the first combustion chamber when the slider is moved toward the first end of the cavity. The second intake channels provide a fluid flow path between the second intake space and the second combustion chamber when the slider is moved toward the second end of the cavity.

In a preferred embodiment, the engine is configured such that the first intake space may be selectively placed in fluid communication with the first combustion chamber. In this preferred embodiment, the motion of the slider may be used to pump a combustible charge from the first intake space into the first combustion chamber. The first intake space and the first combustion chamber may be configured such that compression of the combustible charge within the first combustion chamber causes the combustible charge to ignite by spontaneous combustion.

An engine in accordance with another embodiment of the present invention comprises a housing having an elongated cavity. The elongated cavity has a first chamber, a second chamber and a third chamber. The first chamber is separated from the second chamber by a first wall and the second chamber is separated from the third chamber by a second wall. A first channel then extends through the first wall between the first chamber and the second chamber and a second channel extends through the second wall between the second chamber and the third chamber.

The engine also includes a piston assembly having a first piston portion, a second piston portion and a third piston portion. The first piston portion is attached to the second piston portion via a first connecting member and the second piston portion is connected to the third piston portion via a second connecting member. The first piston portion is slidably positioned within the first chamber, the second piston portion is slidably positioned within the second chamber, and the third piston portion is slidably positioned within the third chamber. The first connecting member extends through the first channel and the second connecting member extending through the second channel of the housing. A first combustion chamber is defined by a space between the first piston portion and the first wall, and a second combustion chamber defined by a space between the third piston portion and the second wall.

The housing further includes a first exhaust port, a second exhaust port, and an intake port. The intake port is preferably in fluid communication with the second cavity when the second piston portion is slidably positioned either toward the first wall or second wall. The first exhaust port is preferably in fluid communication with the first combustion chamber when the second piston portion is slidably positioned toward the first wall. The second exhaust port is preferably in fluid communication with the second combustion chamber when the second piston portion is slidably positioned toward the second wall.

A first intake space is defined between the second piston portion and the first wall, and a second intake space is defined between the second piston portion and the second wall. One or more of first intake channels preferably extend between the first intake space and the first combustion chamber when the second piston portion is slidably positioned toward the first wall. One or more of second intake channels also preferably extend between the second intake space and the second combustion chamber when the second piston portion is slidably positioned toward the second wall.

It is contemplated that the engine of the present invention may be formed on a larger scale using conventional casting techniques or on a smaller micro scale using integrated circuit processing techniques.

DETAILED DESCRIPTION OF THE INVENTION

The following detailed description should be read with reference to the drawings, in which like elements in different drawings are numbered in like fashion. The drawings which are not necessarily to scale, depict selected embodiments and are not intended to limit the scope of the invention. In some cases, the drawings may be highly diagrammatic in nature. Examples of constructions, materials, dimensions, and manufacturing processes are provided for various elements. Those skilled in the art will recognize that many of the examples provided have suitable alternatives which may be utilized.

Figure 1:
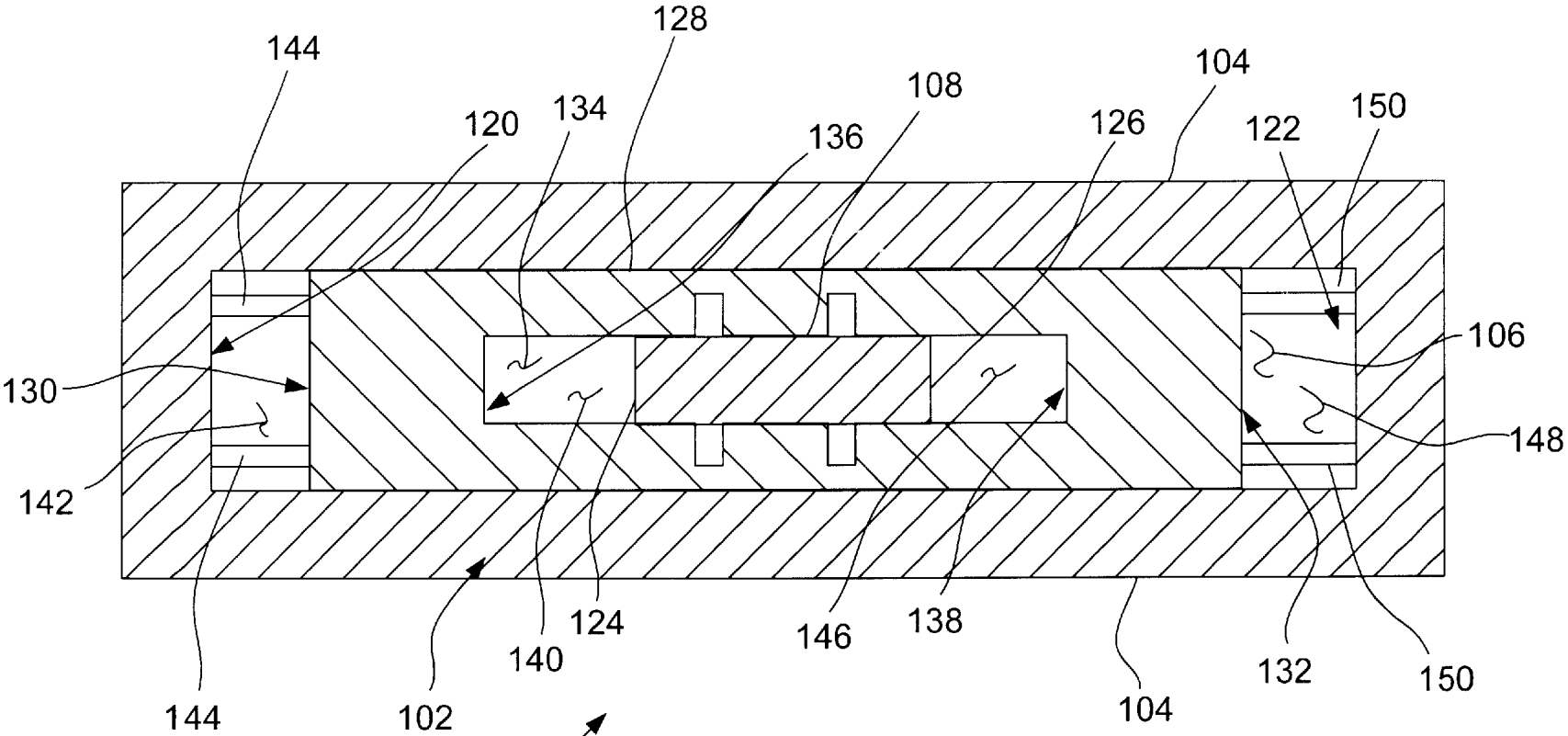
FIG. 1 is a cross sectional view of an engine in accordance with an exemplary embodiment of the present invention.

FIG. 1 is a cross sectional view of an engine 100 in accordance with an exemplary embodiment of the present invention. The engine 100 comprises a housing is 102 including a plurality of housing walls 104 defining an elongated cavity 106 having a first end 120 and a second end 122. A fixed piston 108 is located in the cavity 106 and fixedly attached to the housing 102. The fixed piston 108 has a first end 124 toward the first end 120 of the cavity 106 and a second end 126 toward the second end 122 of the cavity 106.

A slider 128 is slidably disposed within the cavity 106. The slider 128 has a first end 130 toward the first end 120 of the cavity 106 and a second end 132 toward the second end 122 of the cavity 106. The slider 128 further has a central channel 134 for slidably receiving the fixed piston 108. The central channel 134 has a first end 136 adjacent the first end 124 of the fixed piston 108 and a second end 138 adjacent the second end 126 of the fixed piston 108. The position of slider 128 in the embodiment of FIG. 1 may be referred to as a central position.

A first combustion chamber 140 is defined by a space between the first end 136 of the central channel 134 and the first end 124 of the fixed piston 108. A first intake space 142 is defined by the space between the first end 130 of the slider 128 and the first end 120 of the cavity 106.

In a preferred embodiment, the engine 100 is configured such that the first intake space 142 may be selectively placed in fluid communication with the first combustion chamber 140. In this preferred embodiment, the motion of the slider 128 may be used to pump a combustible charge from the first intake space 142 into the first combustion chamber 140. The first intake space 142 and the first combustion chamber 140 may be configured such that compression of the combustible charge within the first combustion chamber 140 causes the combustible charge to ignite by spontaneous combustion.

In the embodiment of FIG. 1, a plurality of first intake channels 144 are defined by the housing 102. The first intake channels 144 may be utilized to selectively provide a fluid (liquid or gas) flow path between the first intake space 142 and the first combustion chamber 140 when the slider 128 is moved toward the first end 120 of the cavity 106.

A second combustion chamber 146 is defined by a space between the second end 138 of the central channel 134 and the second end 126 of the fixed piston 108. A second intake space 148 is defined by the space between the second end 132 of the slider 128 and the second end 122 of the cavity 106.

In a preferred embodiment, the engine 100 is configured such that the second intake space 148 may be selectively placed in fluid communication with the second combustion chamber 146. In this preferred embodiment, the motion of the slider 128 may be used to pump a combustible charge from the second intake space 148 into the second combustion chamber 146. The second intake space 148 and the second combustion chamber 146 may be configured such that compression of the combustible charge within the second combustion chamber 146 causes the combustible charge to ignite by spontaneous combustion.

In the embodiment of FIG. 1, a plurality of second intake channels 150 are defined by the housing. The second intake channels 150 selectively provide a fluid flow path between the second intake space 148 and the second combustion chamber 146 when the slider 128 is moved toward the second end 122 of the cavity 106.

In one embodiment of the present invention, the combustible charge comprises fuel and air. Examples of fuels that may be suitable in some applications include liquid fuels, gaseous fuels, vaporous fuels, or combinations thereof so that an essentially gaseous combustible charge can be moved to the combustion chambers. The intake channels preferably are used to provide a fluid path for moving the fuel/air mixture into the combustion chambers.

Figure 2:
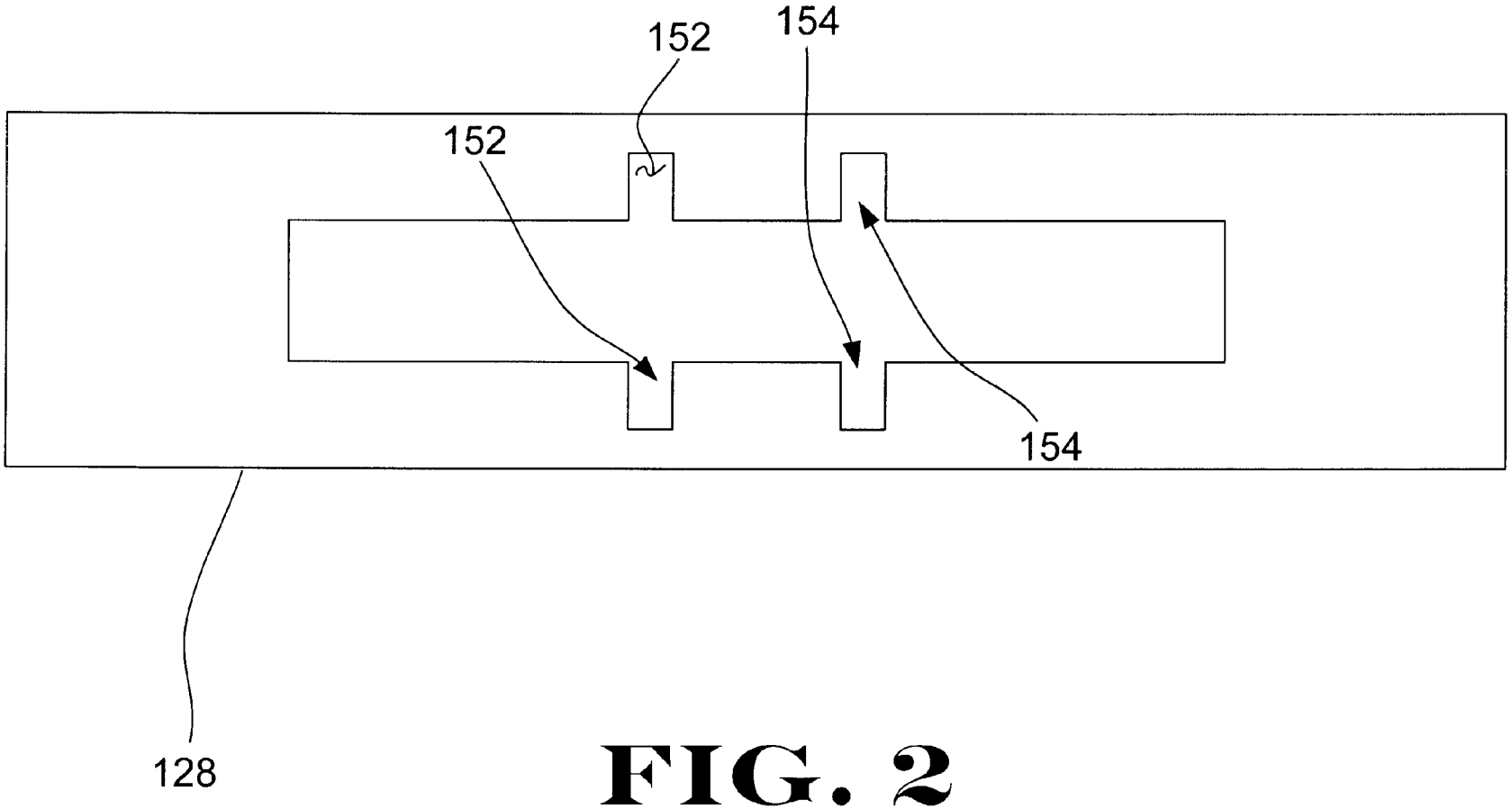
FIG. 2 is a plan view of a slider of the engine of FIG. 1.

FIG. 2 is a plan view of the slider 128 of the engine 100 of FIG. 1. In FIG. 2 it may be appreciated that the slider 128 defines a plurality of first intake cavities 152 and a plurality of second intake cavities 154. In a preferred embodiment, the first intake cavities 152 and the second intake cavities 154 are configured such that they are selectively covered and uncovered by the fixed piston 108. Also in a preferred embodiment, the first intake cavities 152 are configured such that they are selectively placed in fluid communication with the first intake channels 144 defined by the housing 102. Also in a preferred embodiment, the second intake cavities 154 are configured such that they are selectively placed in fluid communication with the second intake channels 150 defined by the housing 102.

Figure 3:
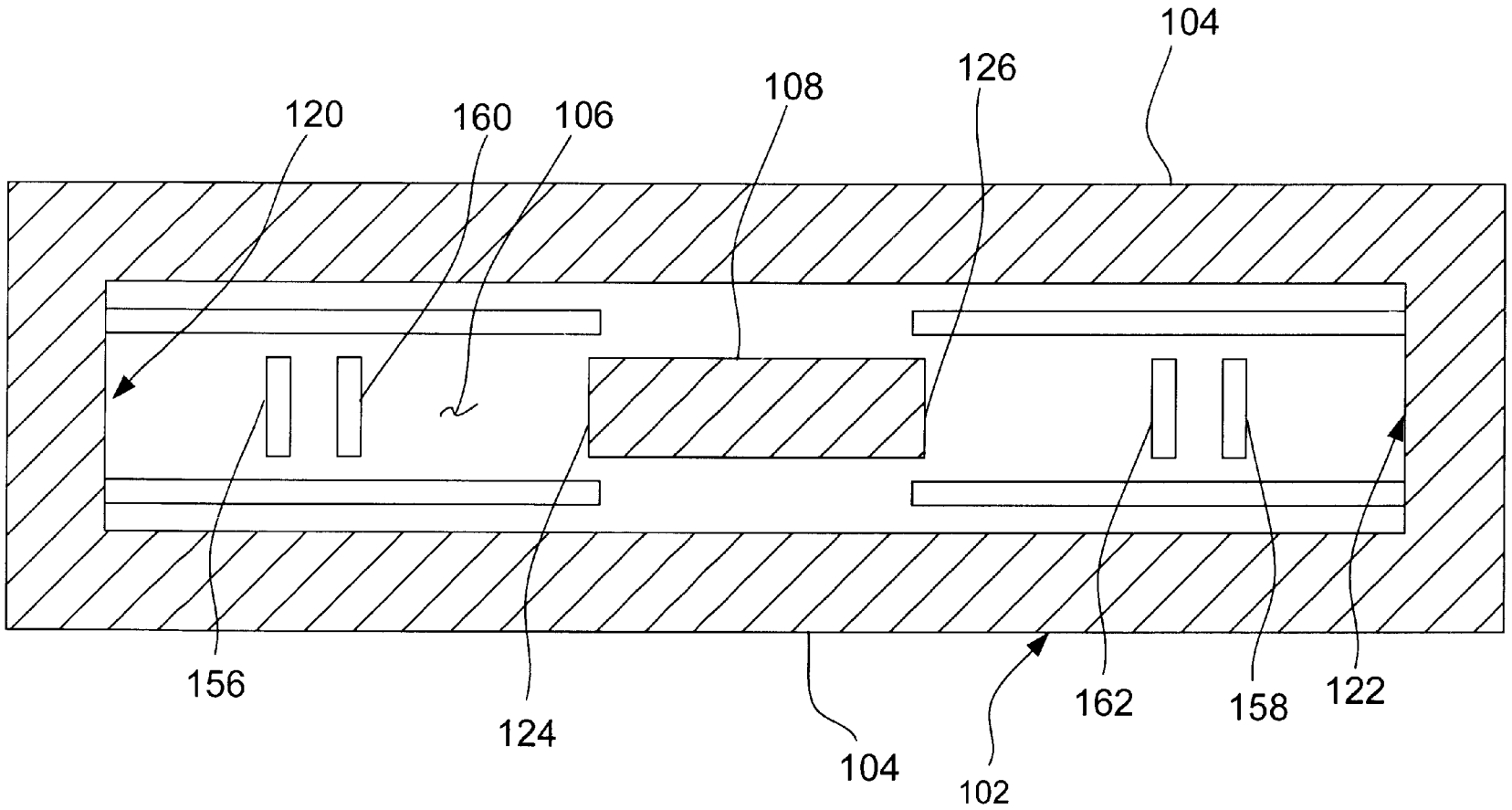
FIG. 3 is a cross sectional view of a housing of the engine of FIG. 1.

FIG. 3 is a cross sectional view of the housing 102 of the engine 100 of FIG. 1. The housing 102 includes a plurality of housing walls 104 defining an elongated cavity 106 having a first end 120 and a second end 122. A fixed piston 108 is located in the cavity 106 and fixedly attached to the housing 102. The fixed piston 108 has a first end 124 toward the first end 120 of the cavity 106 and a second end 126 toward the second end 122 of the cavity 106.

Housing 102 also defines a first intake port 156. During operation of engine 100, the first intake port 156 is selectively covered and uncovered by slider 128. First intake port 156 is preferably in fluid communication with the first intake space 142 defined by the space between the first end 130 of the slider 128 and the first end 120 of the cavity 106 when the slider 128 is slidably disposed toward the second end 122 of the cavity 106.

Housing 102 also defines a second intake port 158. During operation of engine 100, the second intake port 158 may be selectively covered and uncovered by slider 128. The second intake port 158 is preferably in fluid communication with the second intake space 148 defined by the space between the second end 132 of the slider and the second end 122 of the cavity 106 when the slider 128 is slidably disposed toward the first end 120 of the cavity 106.

A first exhaust port 160 and a second exhaust port 162 are also defined by the housing 102. During operation of engine 100, first exhaust port 160 and a second exhaust port 162 are preferably selectively covered and uncovered by slider 128. The first exhaust port 160 is preferably in fluid communication with the first combustion chamber 140 when the slider 128 is slidably disposed toward the first end 120 of the cavity 106. The second exhaust port 162 is preferably in fluid communication with the second combustion chamber 146 when the slider 128 is slidably disposed toward the second end 122 of the cavity 106.

Figure 4:
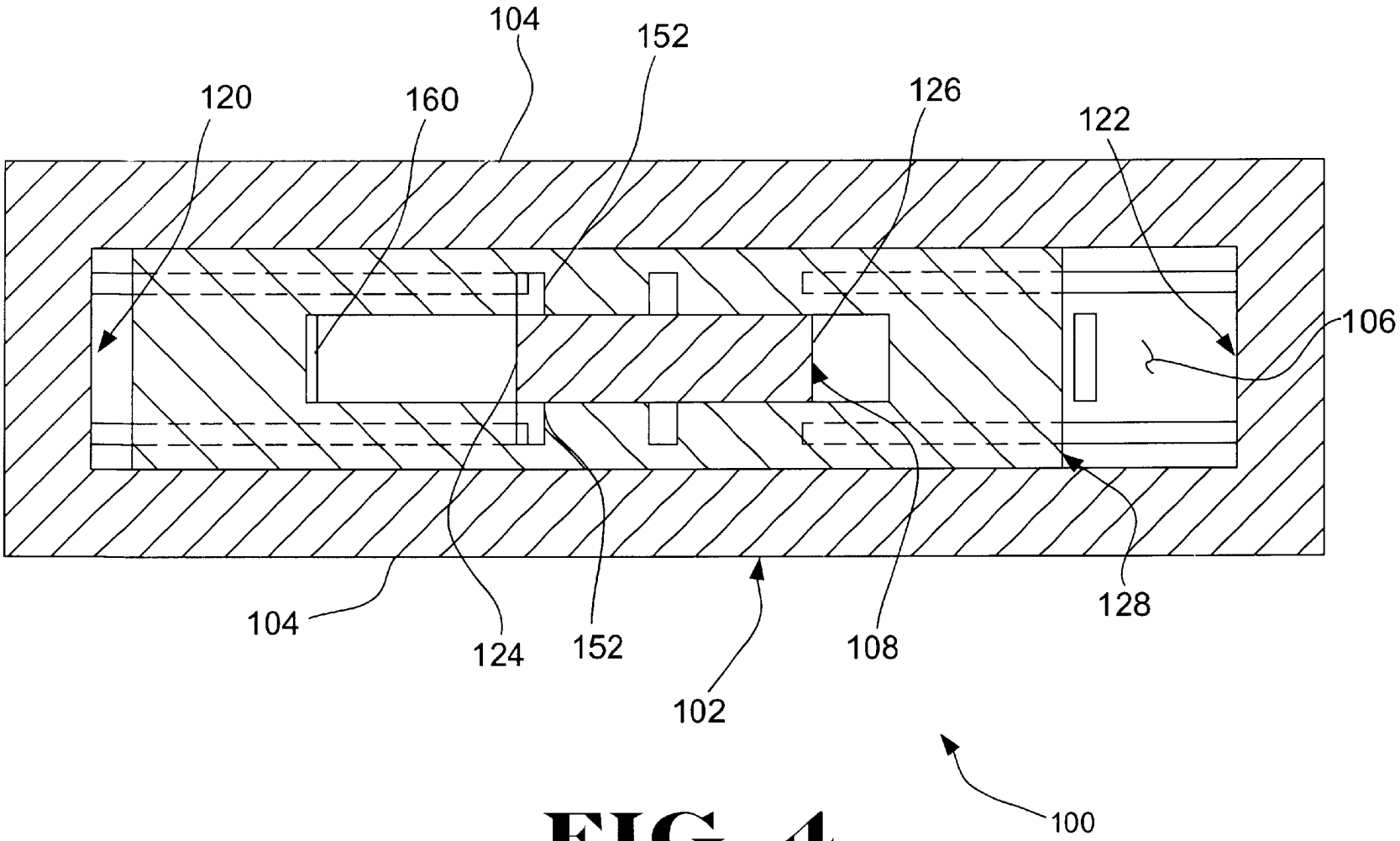
FIG. 4 is an additional cross sectional view of the engine of FIG. 1 in which the slider of the engine in disposed in a first position.

FIG. 4 is an additional cross sectional view of the engine 100 of FIG. 1. The engine 100 comprises a housing 102 including a plurality of housing walls 104 defining an elongated cavity 106 having a first end 120 and a second end 122. A fixed piston 108 is located in the cavity 106 and fixedly attached to the housing 102. The fixed piston 108 has a first end 124 toward the first end 120 of the cavity 106 and a second end 126 toward the second end 122 of the cavity 106.

A slider 128 is slidably disposed within the cavity 106. The position of slider 128 in the embodiment of FIG. 4 may be referred to as a first position. In FIG. 4, it may be appreciated that the slider 128 and the fixed piston 108 are configured such that the first exhaust port 160 is at least partially uncovered and the first intake cavities 152 are completely covered by the fixed piston 108 when the slider 128 is in the first position. When the first exhaust port 160 is at least partially uncovered, burned gasses within the first combustion chamber 140 may exit the first combustion chamber 140 through the first exhaust port 160.

Figure 5:
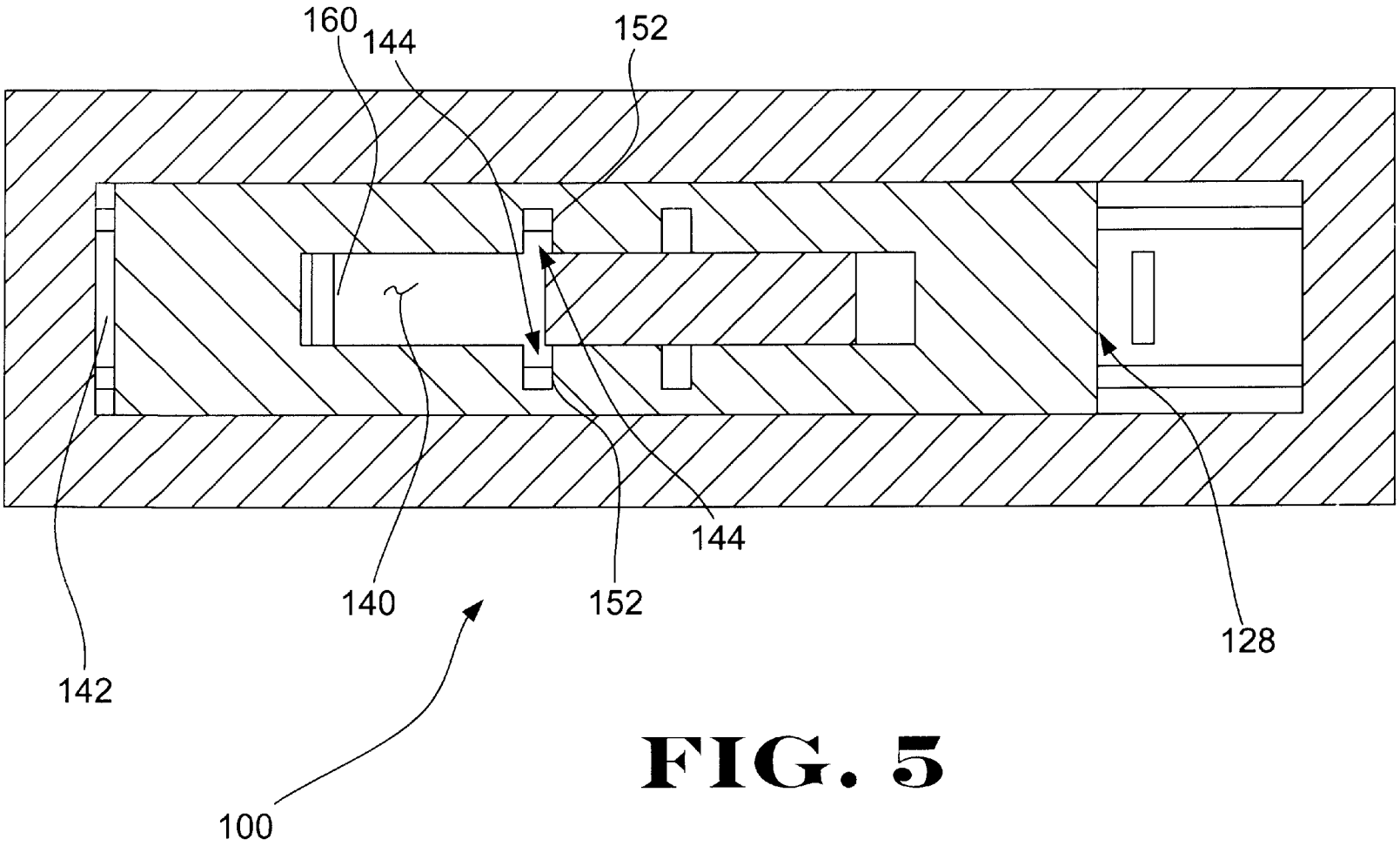
FIG. 5 is an additional cross sectional view of the engine of FIG. 4 in which the slider of the engine has been advanced in a leftward direction away from the first position shown in FIG. 4.

FIG. 5 is an additional cross sectional view of the engine 100 of FIG. 1 and FIG. 4. In the embodiment of FIG. 5, slider 128 has been advanced in a leftward direction away from the first position shown in FIG. 4. Travel by the slider 128 in the leftward direction causes the first intake cavities 152 defined by slider 128 to be at least partially uncovered while the first exhaust port 160 remains uncovered.

Uncovering first intake cavities 152 preferably allows a combustible charge to pass from the first intake space 142 to the first combustion chamber 140 via the first intake cavities 152 and the first intake channels 144. Uncovering the first exhaust port 160 allows burned gasses within the first combustion chamber 140 to exit the first combustion chamber 140. In a preferred embodiment, the burned gasses exiting the first combustion chamber 140 and the combustible charge entering the first combustion chamber 140 travel in a similar general direction, with the pressure of the combustible charge helping to expel the burned gasses from the first combustion chamber 140.

Figure 6:
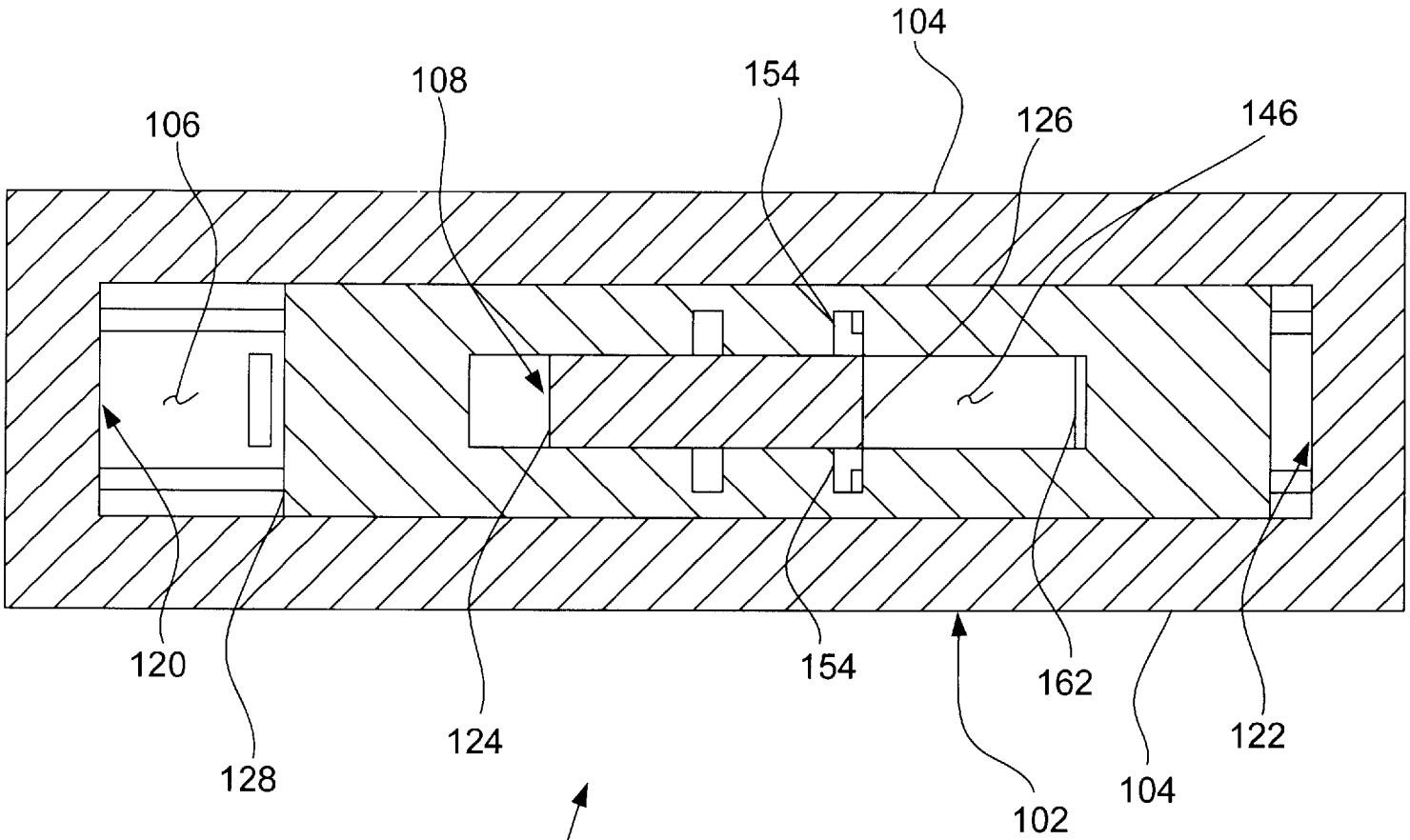
FIG. 6 is an additional cross sectional view of the engine of FIG. 1 in which the slider of the engine in disposed in a second position.

FIG. 6 is an additional cross sectional view of the engine 100 of FIG. 1. The engine 100 comprises a housing 102 including a plurality of housing walls 104 defining an elongated cavity 106 having a first end 120 and a second end 122. A fixed piston 108 is located in the cavity 106 and fixedly attached to the housing 102. The fixed piston 108 has a first end 124 toward the first end 120 of the cavity 106 and a second end 126 toward the second end 122 of the cavity 106.

A slider 128 is slidably disposed within the cavity 106. The position of slider 128 in the embodiment of FIG. 6 may be referred to as a second position. In FIG. 6, the slider 128 and the fixed piston 108 are configured such that the second exhaust port 162 is at least partially uncovered and the second intake cavities 154 are completely covered by the fixed piston 108 when the slider 128 is in the second position. When the second exhaust port 162 is at least partially uncovered, burned gasses within the second combustion chamber 146 may exit the second combustion chamber 146 through the second exhaust port 162.

Figure 7:
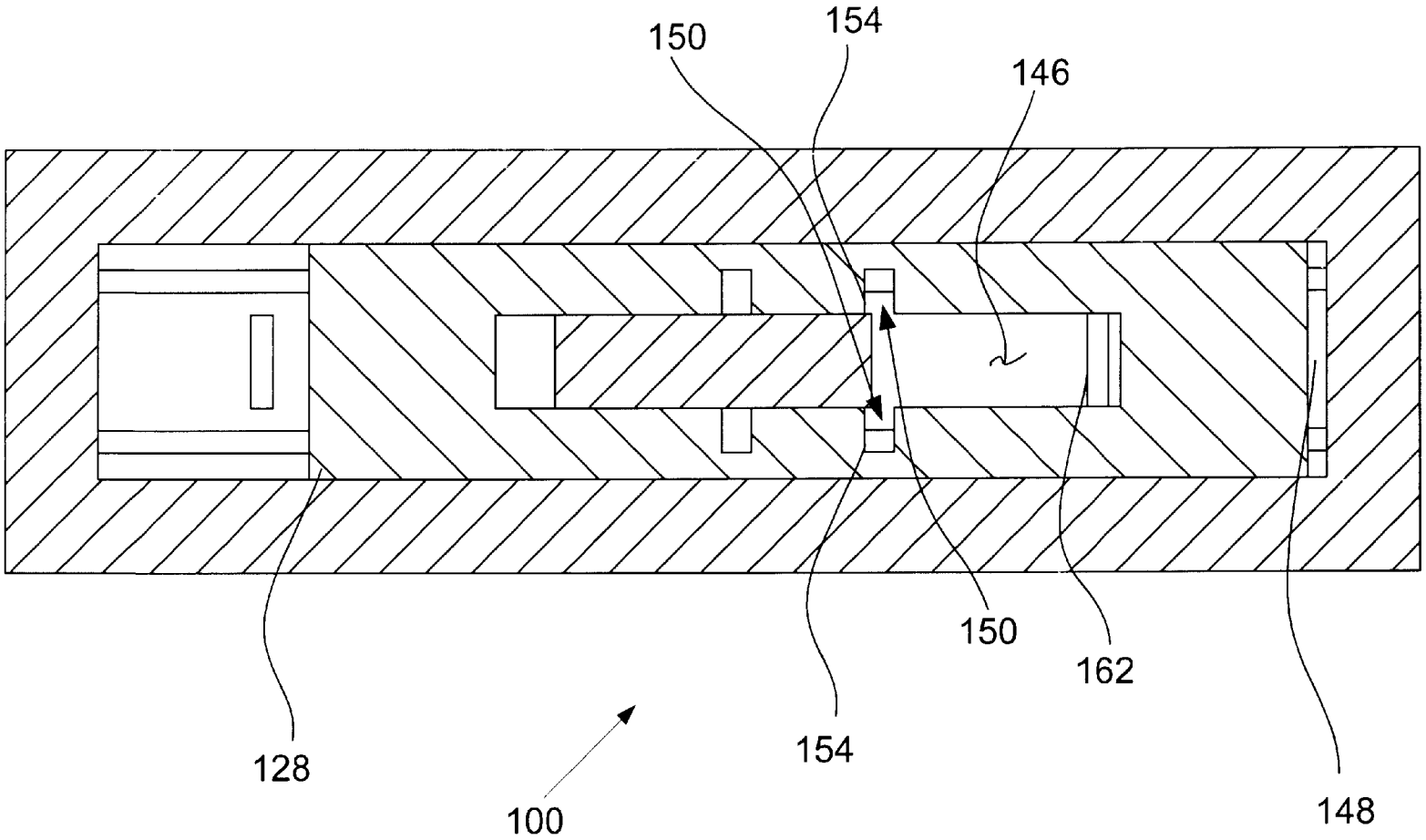
FIG. 7 is an additional cross sectional view of the engine of FIG. 6 in which the slider of the engine has been advanced in a rightward direction away from the second position shown in FIG. 6.

FIG. 7 is an additional cross sectional view of the engine 100 of FIG. 1 and FIG. 6. In the embodiment of FIG. 7, slider 128 has been advanced in a rightward direction away from the second position shown in FIG. 6. Travel by the slider 128 in the rightward direction causes the second intake cavities 154 defined by slider 128 to be at least partially uncovered while the second exhaust port 162 remains uncovered.

Uncovering second intake cavities 154 preferably allows a combustible charge to pass from the second intake space 148 to the second combustion chamber 146 via the second intake cavities 154 and the second intake channels 150. Uncovering the second exhaust port 162 allows burned gasses within the second combustion chamber 146 to exit the second combustion chamber 146. In a preferred embodiment, the burned gasses exiting the second combustion chamber 146 and the combustible charge entering the second combustion chamber 146 travel in a similar general direction, with the pressure of the combustible charge helping to expel the burned gasses from the second combustion chamber 146.

Figure 8:
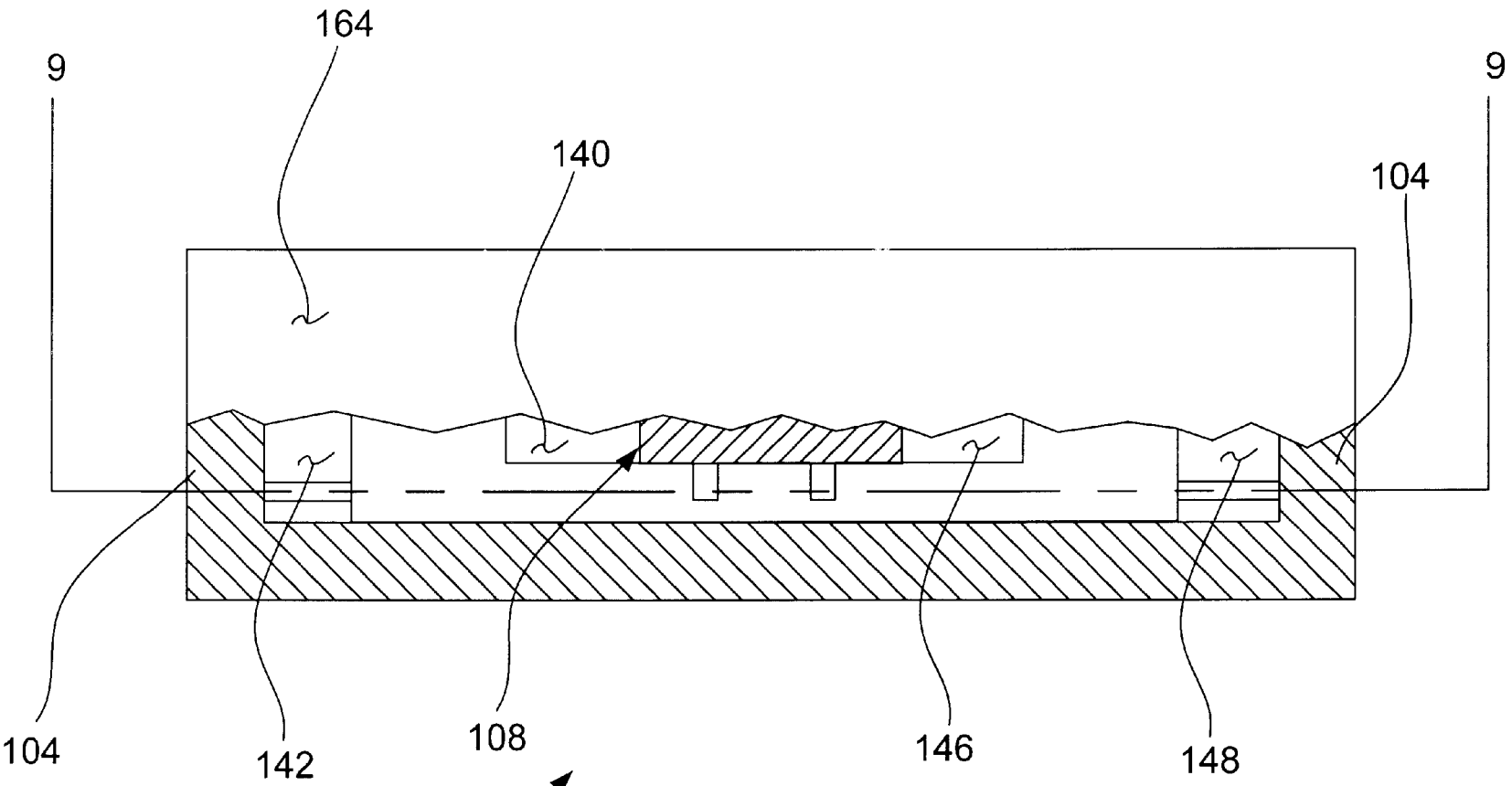
FIG. 8 is a partial cross sectional view of the engine of FIG. 1, in which it may be appreciated that the housing of the engine includes a cover.

FIG. 8 is a partial cross sectional view of the engine 100. In FIG. 8 it may be appreciated that the housing 102 of the engine 100 includes a cover 164. Cover 164 is preferably fixed to housing walls 104 and fixed piston 108. Cover 164 preferably partially encloses first intake space 142, first combustion chamber 140, second intake space 148, and second combustion chamber 146. It is contemplated that the intake channels 144 and 150 may be provided in cover 164, rather than or in addition to, the housing 102.

Figure 9:
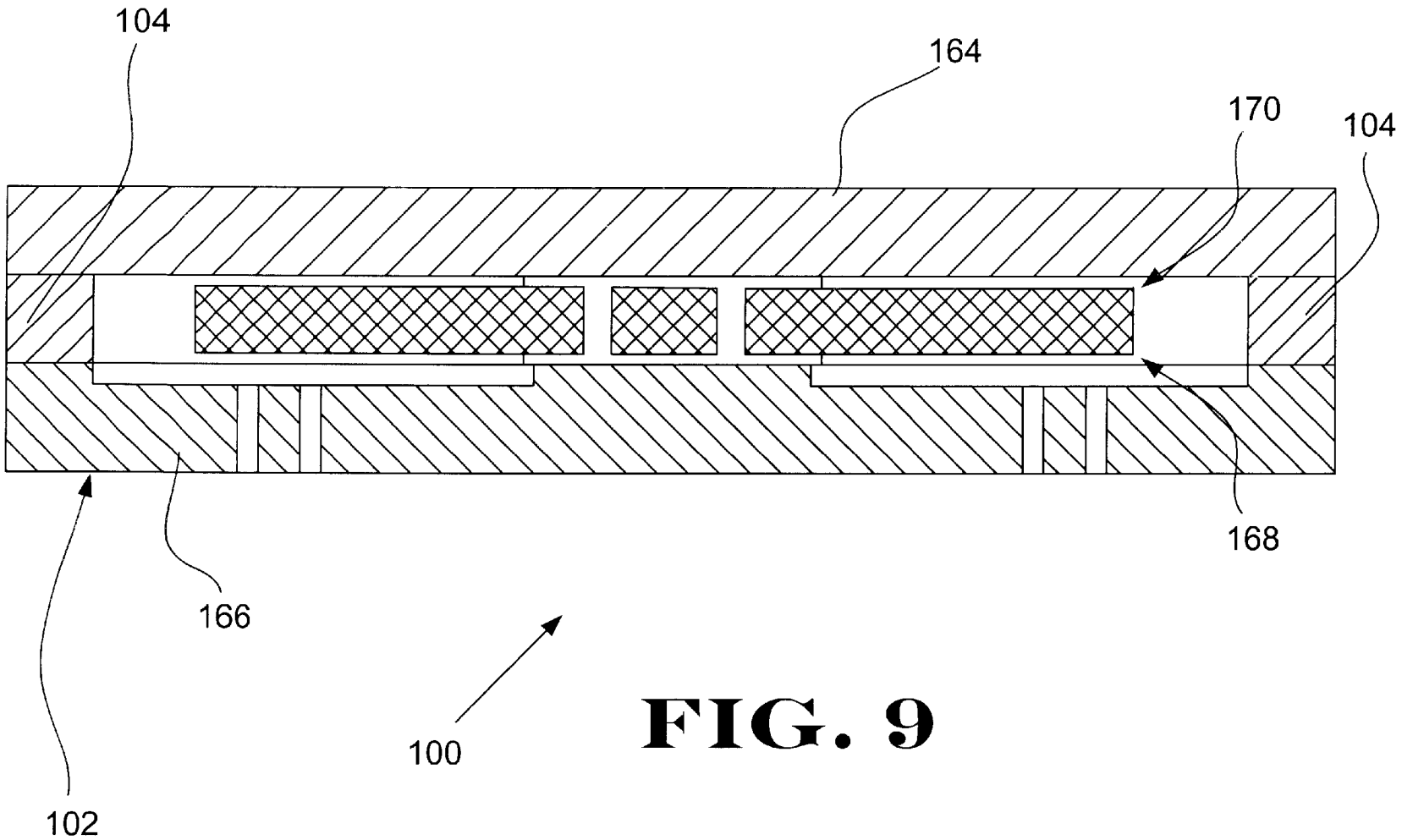
FIG. 9 is a cross sectional view of the engine taken along a section line 9—9 shown in FIG. 8.

FIG. 9 is a cross sectional view of the engine 100 taken along section line 9—9 shown in FIG. 8. In FIG. 9 it may be appreciated that the housing 102 includes a substrate 166, the housing walls 104, and the cover 164. In the embodiment of FIG. 9, a first gap 168 is defined by the substrate 166 and the slider 128, and a second gap 170 is defined by the cover 164 and the slider 128. For purposes of 10 illustration, the first gap 168 and the second gap 170 are shown to be relatively large. In a preferred embodiment of the present invention, the first gap 168 and the second gap 170 are relatively small.

Figure 10:
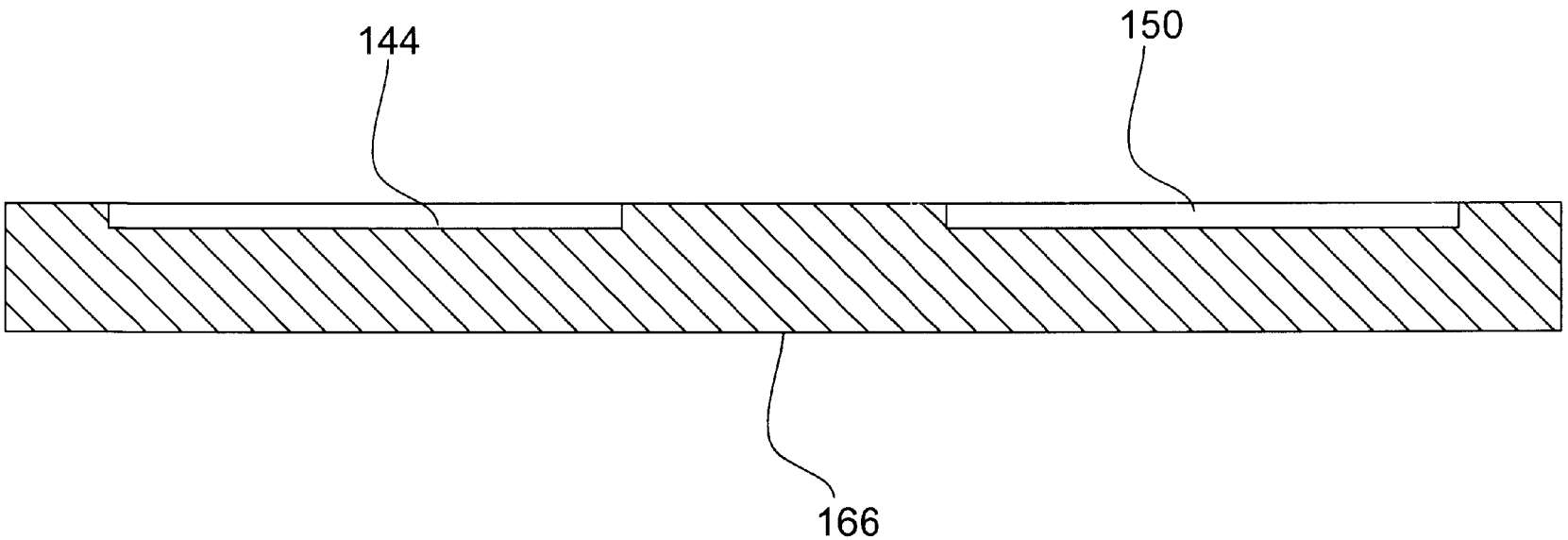
FIG. 10 is a cross sectional view of a substrate of the engine of FIG. 8 taken along section line A—A shown in FIG. 8.

FIG. 10 is a cross sectional view of the substrate 166 taken along section line 9—9 shown in FIG. 8. A method of fabricating engine 100 may begin with the step of providing the substrate 166. The method may also include the step of etching the substrate 166 to form a plurality of first intake channels 144 and a plurality of second intake channels 150.

Figure 11:
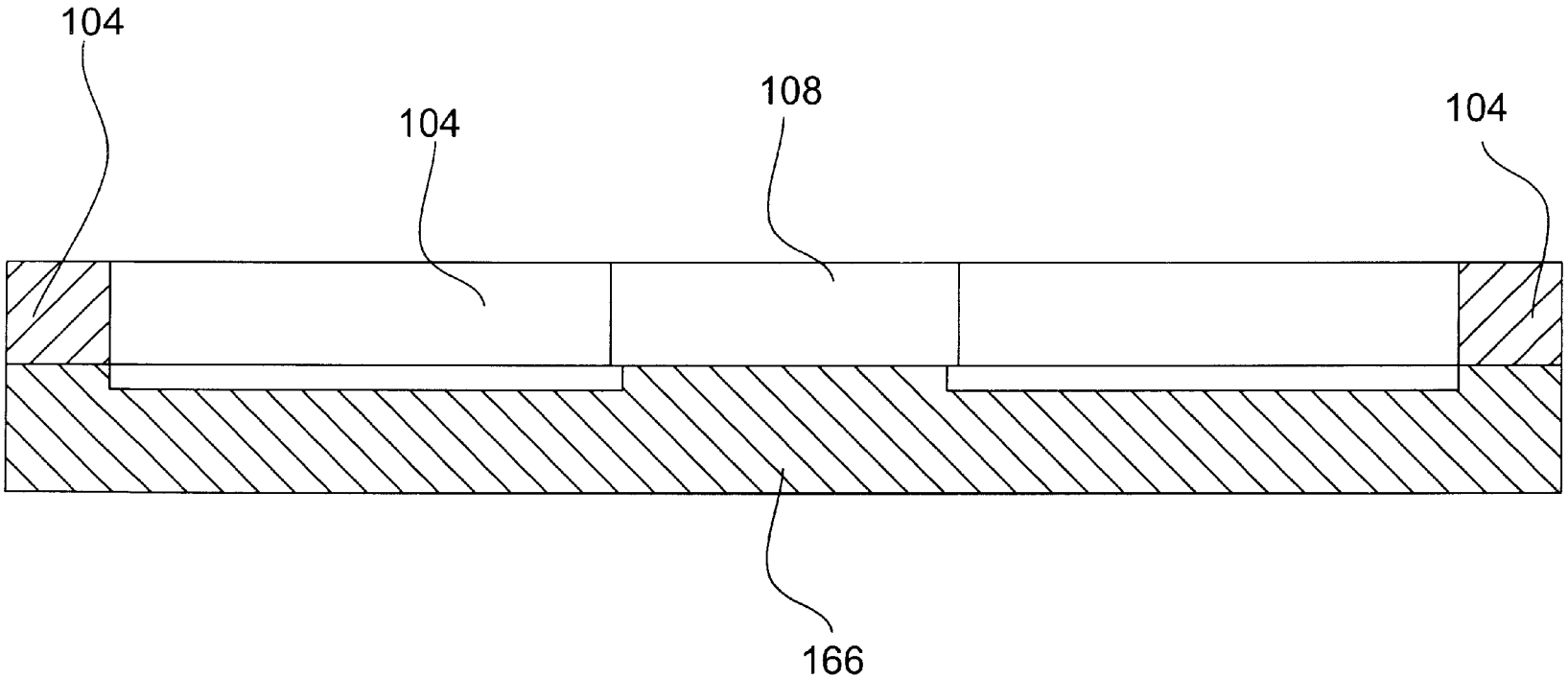
FIG. 11 is a cross sectional view of an assembly including the substrate of FIG. 10.

FIG. 11 is a cross sectional view of an assembly including the substrate 166 of FIG. 10. The assembly shown in FIG. 11 includes a fixed piston 108 and a plurality of housing walls 104 disposed on substrate 166. The fixed piston 108 and the housing walls 104 are preferably fixed or integral with substrate 166.

Figure 12:
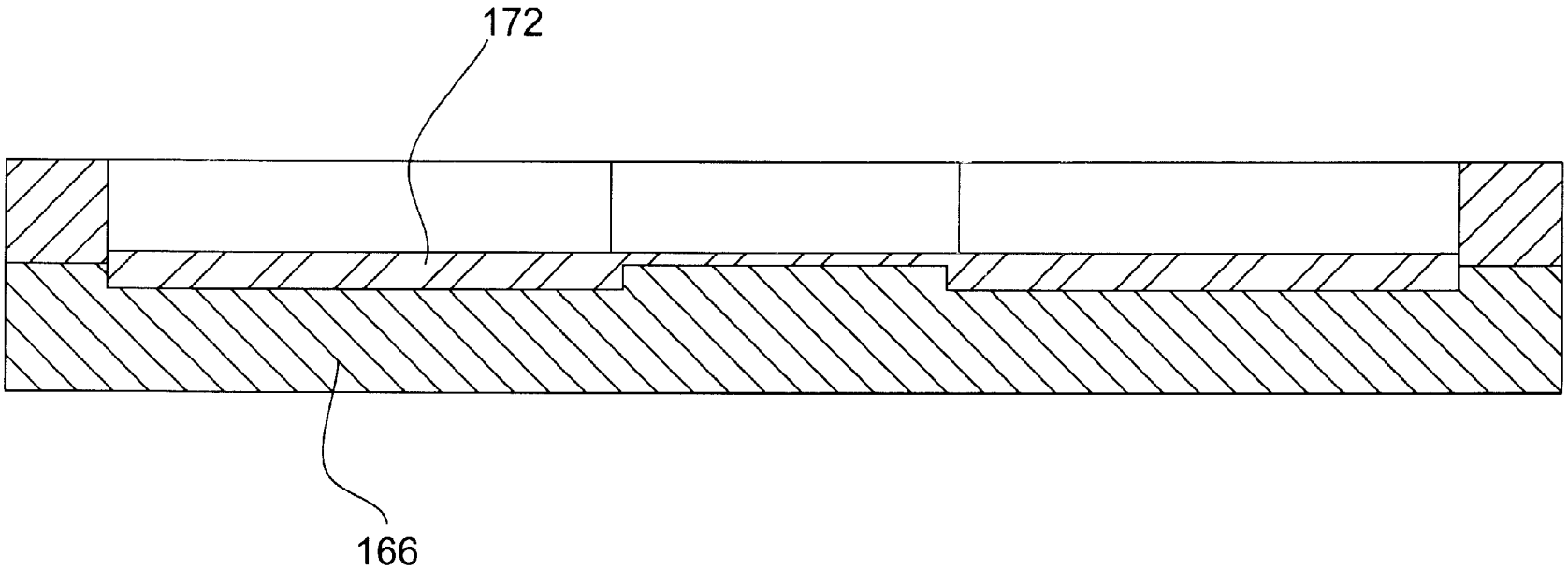
FIG. 12 is a cross sectional view of an assembly including the assembly of FIG. 11.
Figure 13:
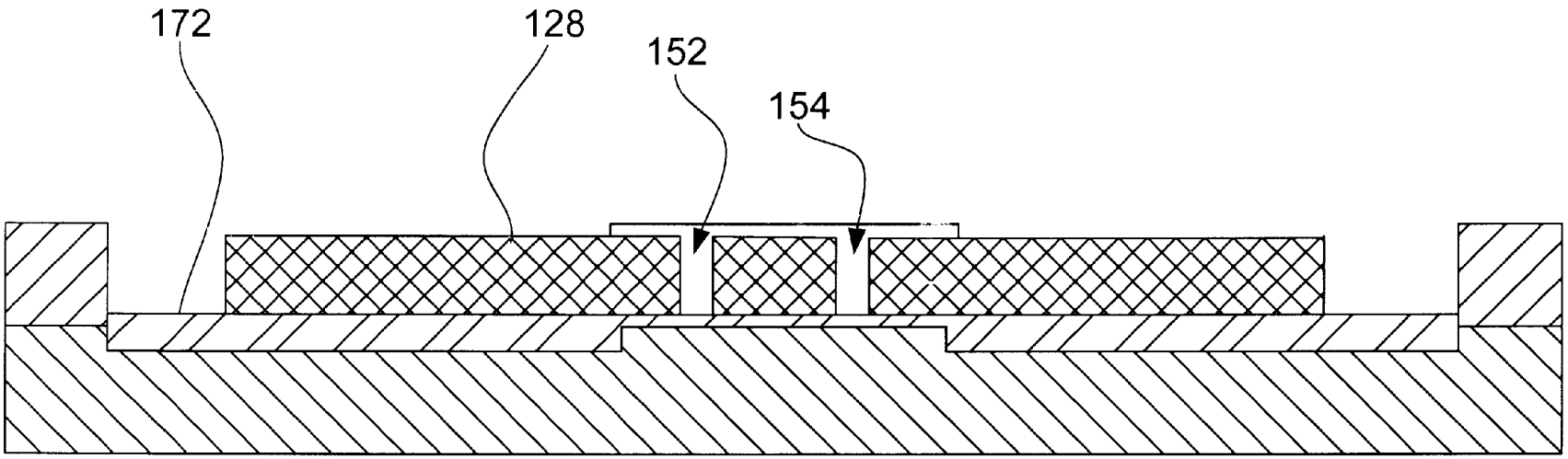
FIG. 13 is a cross sectional view of an assembly including the assembly of FIG. 12.
Figure 14:
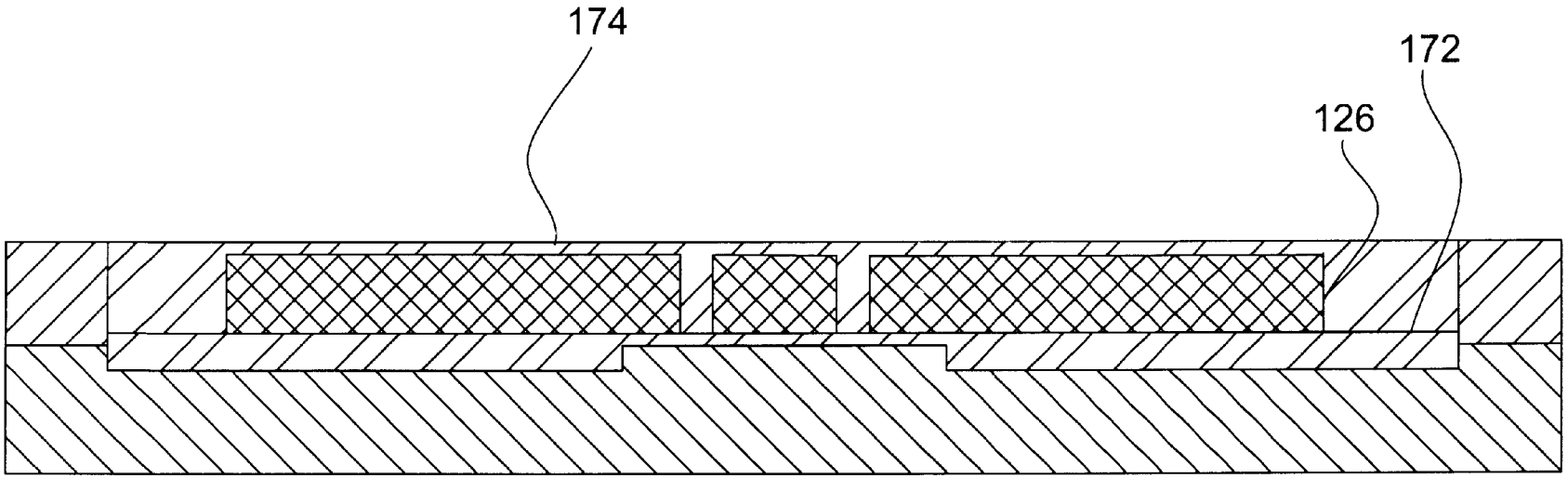
FIG. 14 is a cross sectional view of an assembly including the assembly of FIG. 13.
Figure 15:
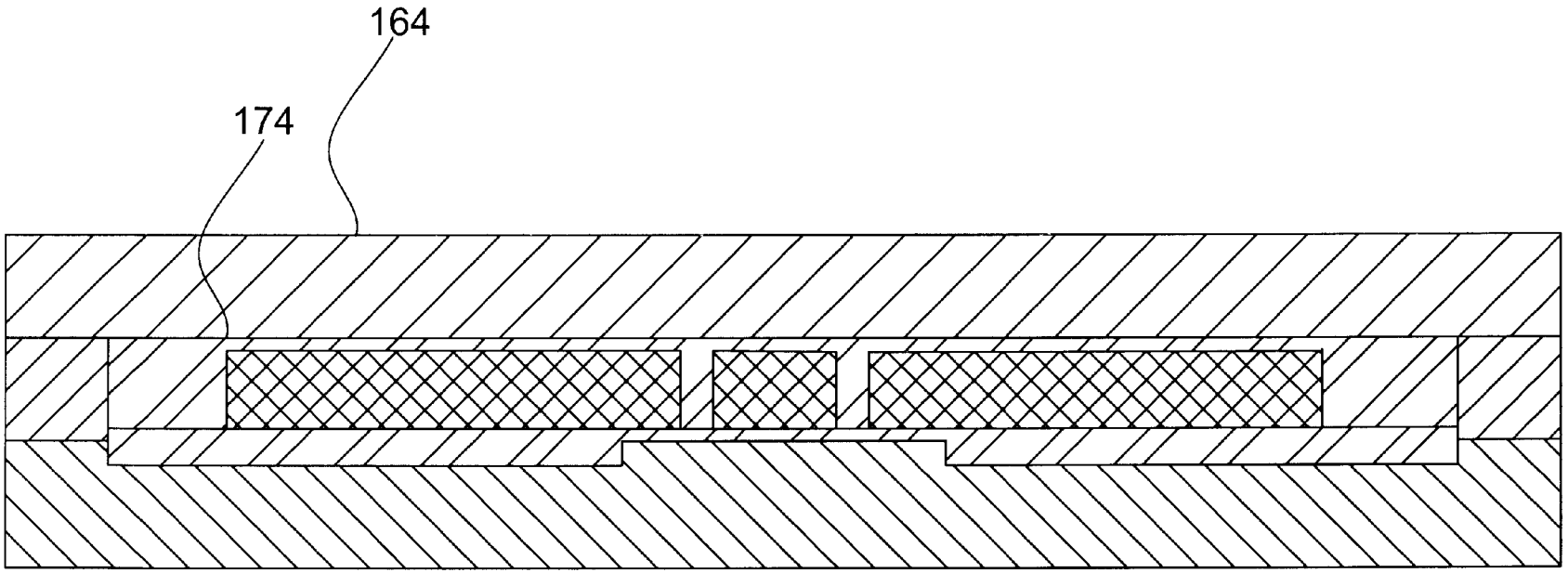
FIG. 15 is a cross sectional view of an assembly including the assembly of FIG. 14.

FIG. 12 is a cross sectional view of the assembly of FIG. 11 with a first sacrificial layer 172 disposed upon substrate 166. FIG. 13 is a cross sectional view of the assembly of FIG. 12 with a slider 128 disposed upon the first sacrificial layer 172. In FIG. 13 it may be appreciated that slider 128 defines a plurality of first intake cavities 152 and a plurality of second intake cavities 154. FIG. 14 is a cross sectional view of the assembly of FIG. 13 with a second sacrificial layer 174 disposed upon the slider 128 and the first sacrificial layer 172, as shown. FIG. 15 is a cross sectional view of the assembly of FIG. 14 with a cover 164 disposed upon the second sacrificial layer 174 and the housing walls. To free the slider from the housing, the sacrificial layers 172 and 174 may be selectively removed, using well known etching techniques.

Having thus described FIGS. 1–15, methods for forming the engine are now described. It should be understood that these steps are only illustrative. It should also be understood that steps may be omitted from each process and/or the order of the steps may be changed without deviating from the spirit or scope of the invention. It is anticipated that in some applications, two or more steps may be performed more or less simultaneously to promote efficiency.

A method of fabricating engine 100 may include the steps of:

1) Providing a substrate;
2) Etching the substrate to form a plurality of first intake channels and a plurality of second intake channels;
3) Growing or otherwise providing a plurality of housing walls and a fixed piston on the substrate;
4) Growing or otherwise providing a first sacrificial layer on top of the substrate proximate the housing walls and the fixed piston;
5) Growing or otherwise providing a slider on top of the first sacrificial layer;
6) Growing or otherwise providing a second sacrificial layer on top of the slider;
7) Growing a cover on top of the housing walls, the fixed piston, and the second sacrificial layer;
8) Etching a back side of the substrate forming a first exhaust port, a second exhaust port, a first intake port, and a second intake port; and
9) Removing the first sacrificial layer and the second sacrificial layer through one or more of the first exhaust port, second exhaust port, first intake port and/or second intake port to release the slider.

An additional method of fabricating engine 100 may include the steps of:

1) Providing a substrate;
2) Etching the top surface of the substrate to form a plurality of walls and a fixed piston;
3) Etching substrate to form a plurality of first intake channels and a plurality of second intake channels;
4) Growing or otherwise providing a first sacrificial layer on top of the substrate proximate the housing walls and the fixed piston;
5) Growing or otherwise providing a slider on top of the first sacrificial layer;
6) Growing or otherwise providing a second sacrificial layer on top of the slider;
7) Growing or otherwise providing a cover on top of the housing walls, the fixed piston and the second sacrificial layer;
8) Etching a backside of the substrate forming a first exhaust port, a second exhaust port, a first intake port, a second intake port; and
9) Removing the first sacrificial layer and the second sacrificial layer through one or more of the first intake port, second intake port, first exhaust port and/or the second exhaust port to release the slider.

Figure 16:
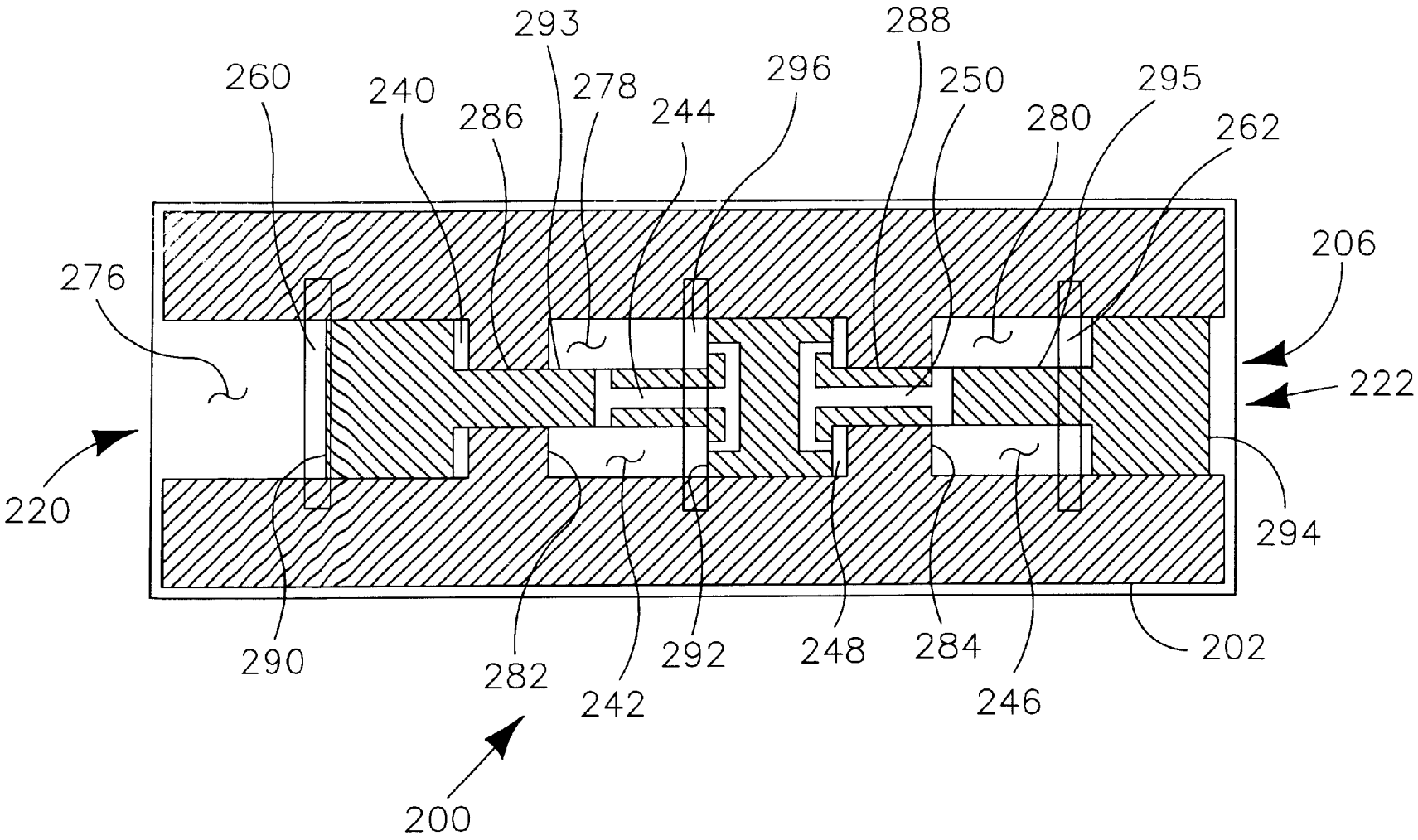
FIG. 16 is a cross sectional view of an engine in accordance with an additional exemplary embodiment of the present invention.

FIG. 16 is a cross sectional view of an engine 200 in accordance with another exemplary embodiment of the present invention. The engine 200 comprises a housing 202 defining an elongated cavity 206 having a first end 220, a second end 222, a first chamber 276, a second chamber 278, and a third chamber 280. The first chamber 276 is preferably separated from the second chamber 278 by a first wall 282 and the second chamber 278 is preferably separated from the third chamber 280 by a second wall 284. A first channel 286 extends through the first wall 282 between the first chamber 276 and the second chamber 278 and a second channel 288 extends through the second wall 284 between the second chamber 278 and the third chamber 280.

The engine 200 also includes a piston assembly having a first piston portion 290, a second piston portion 292, and a third piston portion 294. The first piston portion 290 is preferably attached to the second piston portion 292 via a first connecting member 293, and the second piston portion 292 is preferably connected to the third piston portion 294 via a second connecting member 295, the first piston portion 290 is slidably positioned within the first chamber 276, the second piston portion 292 is slidably positioned within the second chamber 278 and the third piston portion 294 is slidably positioned within the third chamber 280. The first connecting member 293 extends through the first channel 286 and the second connecting member 295 extends through the second channel 288 of the housing 202.

A first combustion chamber 240 is defined by a space between the first piston portion 290 and the first wall 282, and a second combustion chamber 246 is defined by a space between the third piston portion 294 and the second wall 284. An intake port 296 is in fluid communication with the second chamber 278 when the second piston portion 292 is slidably positioned either toward the first wall 282 or the second wall 284.

A first exhaust port 260 is in fluid communication with the first combustion chamber 240 when the second piston portion 292 is slidably positioned toward the first wall 282. A second exhaust port 262 is in fluid communication with the second combustion chamber 246 when the second piston portion 292 is slidably positioned toward the second wall 284.

A first intake space 242 is defined between the second piston portion 292 and the first wall 282. A second intake space 248 is defined between the second piston portion 292 and the second wall 284. One or more of first intake channels 244 extend between the first intake space 242 and the first combustion chamber 240 when the second piston portion 292 is slidably positioned toward the first wall 282. A network of second intake channels 250 extend between the second intake space 248 and the second combustion chamber 246 when the second piston portion 292 is slidably positioned toward the second wall 284.

During the operation of engine 200, the intake port 296 may be selectively covered and uncovered by second piston portion 292. Intake port 296 is preferably in fluid communication with the first intake space 242 when the second piston portion 292 is slidably disposed toward the second end 222 of the cavity 206. Intake port 296 is preferably in fluid communication with the second intake space 248 when the second piston portion 292 is slidably disposed toward the first end 220 of the cavity 206.

Also during operation of engine 200, the first exhaust port 260 is preferably selectively covered and uncovered by the first piston portion 290 and the second exhaust port 262 is preferably selectively covered and uncovered by the third piston portion 294. The first exhaust port 260 is preferably in fluid communication with the first combustion chamber 240 when the first piston portion 290 is slidably disposed toward the first end 220 of cavity 206. A second exhaust port 262 is preferably in fluid communication with the second combustion chamber 246 when the second piston portion 292 is slidably disposed toward the second end 222 of the cavity 206.

In a preferred embodiment, the engine 200 is configured such that the first intake space 242 may be selectively placed in fluid communication with the first combustion chamber 240. In this preferred embodiment, the motion of the second piston portion 292 may be used to pump a combustible charge from the first intake space 242 into the first combustion chamber 240. The first intake space 242 and the first combustion chamber 240 may be configured such that combustion of the combustible charge within the first combustion chamber 240 causes the combustible charge to ignite by spontaneous combustion. In the embodiment of FIG. 16, one or more first intake channels 244 are defined by the first connecting member 293. The first intake channels 244 may be utilized to selectively provide a fluid path between a first intake space 242 and the first combustion chamber 240 when the first connecting member 293 is moved towards the first end 220 of the cavity 206.

Also in a preferred embodiment, the engine is configured such that the second intake space 248 may be selectively placed in fluid communication with the second combustion chamber 246. In this preferred embodiment, the motion of the second piston portion 292 may be used to pump by combustible charge from the intake space 248 through to the second combustion chamber 246. The second intake space 248 and the second combustion chamber 246 may be configured such that compression of the combustible charge within the second combustion chamber 246 causes the combustible charge to ignite by spontaneous combustion. In the embodiment of FIG. 16, one or more second intake channels 250 are defined by the second connecting member 295. The intake channels 250 selectively provide a fluid flow path between the second intake space 248 and the second combustion chamber 246 when the second connecting member 295 is moved toward the second end 222 of the cavity 206.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The inventions's scope is, of course, defined in the language in which the appended claims are expressed.

What is claimed is:

1. An engine, comprising:

a housing having an elongated cavity, the elongated cavity having a first end, a second end, and internal walls extending therebetween;

a fixed piston located in the cavity and fixedly attached to the housing, the fixed piston having a first end toward the first end of the cavity and a second end toward the second end of the cavity;

a slider slidably disposed within the cavity, the slider having a first end toward the first end of the cavity and a second end toward the second end of the cavity, the slider further having a central channel for slidably receiving the fixed piston, the central channel having a first end adjacent the first end of the fixed piston and a second end adjacent the second end of the fixed piston;

a first combustion chamber defined by a space between the first end of the channel and the first end of the fixed piston;

a second combustion chamber defined by a space between the second end of the channel and the second end of the fixed piston;

a first intake port in the housing, the first intake port in fluid communication with a first intake space defined by the space between the first end of the slider and the first end of the cavity when the slider is slidably disposed toward the second end of the cavity;

a second intake port in the housing, the second intake port in fluid communication with a second intake space defined by the space between the second end of the slider and the second end of the cavity when the slider is slidably disposed toward the first end of the cavity;

a first exhaust port in the housing, the first exhaust port in fluid communication with the first combustion chamber when the slider is slidably disposed toward the first end of the cavity;

a second exhaust port in the housing, the second exhaust port in fluid communication with the second combustion chamber when the slider is slidably disposed toward the second end of the cavity;

one or more first intake channels for providing a fluid flow path between the first intake space and the first combustion chamber when the slider is moved toward the first end of the cavity; and one or more second intake channels for providing a fluid flow path between the second intake space and the second combustion chamber when the slider is moved toward the second end of the cavity.

2. The engine of claim 1, wherein the first intake port is selectively covered by the slider when the slider is slidably disposed away from the second end of the cavity.

3. The engine of claim 1, wherein the second intake port is selectively covered by the slider when the slider is slidably disposed away from the first end of the cavity.

4. The engine of claim 1, wherein the first exhaust port is selectively covered by the slider when the slider is slidably disposed away from the first end of the cavity.

5. The engine of claim 1, wherein the second exhaust port is selectively covered by the slider when the slider is slidably disposed away from the second end of the cavity.

6. The engine of claim 1, wherein the volume of the first combustion chamber increases when the slider travels in a first direction and decreases when the slider travels in a second direction.

7. The engine of claim 1, wherein the slider and the fixed piston are configured such that the first exhaust port is at least partially uncovered and the first intake cavity defined by the slider is completely covered when the slider is in a first position, thereby allowing burned gasses within the first combustion chamber to exit the first combustion chamber through the first exhaust port.

8. The engine of claim 7, wherein travel by the slider away from the first position in a first direction causes the first intake cavity to be at least partially uncovered while the exhaust port remains uncovered thereby allowing a combustible charge to enter the first combustion chamber.

9. The engine of claim 8, wherein the burned gasses exiting the first combustion chamber and the combustible charge entering the first combustion chamber travel in a similar general direction.

10. The engine of claim 1, wherein the slider and the fixed piston are configured such that the second exhaust port is at least partially uncovered and a second intake cavity defined by the slider is completely covered when the slider is in a second position, thereby allowing burned gasses within the second combustion chamber to exit the second combustion chamber through the second exhaust port.

11. The engine of claim 10, wherein travel by the slider away from the second position in a second direction causes the second intake cavity to be at least partially uncovered while the exhaust port remains uncovered thereby allowing a combustible charge to enter the second combustion chamber.

12. The engine of claim 11, wherein the burned gasses exiting the second combustion chamber and the combustible charge entering the second combustion chamber travel in a similar general direction.

13. The engine of claim 1, wherein the one or more first intake channels are configured such that a combustible charge flows between the first intake space and the first combustion chamber when the slider is moved toward the first end of the cavity.

14. The engine of claim 13, wherein the first intake space and the first combustion chamber are configured such that compression of the combustible charge within the first combustion chamber causes the combustible charge to ignite by spontaneous combustion.

15. The engine of claim 13, wherein a volume of the first intake space and a volume of the first combustion chamber are preselected such that compression of the combustible charge within the first combustion chamber causes the combustible charge to ignite by spontaneous combustion.

16. The engine of claim 1, wherein the one or more second intake channels are configured such that a combustible charge flows between the second intake space and the second combustion chamber when the slider is moved toward the second end of the cavity.

17. The engine of claim 13, wherein the second intake space and the second combustion chamber are configured such that compression of the combustible charge within the second combustion chamber causes the combustible charge to ignite by spontaneous combustion.

18. The engine of claim 13, wherein a volume of the second intake space and a volume of the second combustion chamber are preselected such that compression of the combustible charge within the second combustion chamber causes the combustible charge to ignite by spontaneous combustion.

19. A micro-engine, comprising:

a substrate;

a piston formed on the substrate;

a slider configured to form one or more combustion chambers between the slider and the piston, the slider adapted to slide back and forth relative to the piston in a cycle;

one or more intake ports for selectively providing fuel to the one or more combustion chambers during selected times during the cycle; and one or more exhaust ports for selectively venting exhaust from the one or more combustion chambers during selected times during the cycle.

20. A method for forming a micro-engine, comprising the steps of:

providing a substrate;

forming a piston and a slider on the substrate, the slider surrounded by a sacrificial layer; and etching away the sacrificial layer to free the slider.

21. A micro-engine, comprising:

a substrate having a plurality of housing walls, a fixed piston and a channel therebetween;

a slider configured to form one or more combustion chambers between the slider and the fixed piston, the slider adapted to slide back and forth within the channel relative to the fixed piston in a cycle;

one or more intake ports for selectively providing fuel to the one or more combustion chambers during selected times during the cycle; and one or more exhaust ports for selectively venting exhaust from the one or more combustion chambers during selected times during the cycle.

22. A method for forming a micro-engine, comprising the steps of:

providing a substrate;

etching the substrate to form a plurality of first intake channels and a plurality of second intake channels;

forming a plurality of housing walls and a fixed piston on the substrate;

providing a first sacrificial layer on top of the substrate proximal the plurality of housing walls and the fixed piston;

providing a slider on top of the first sacrificial layer;

providing a second sacrificial layer on top of the slider;

providing a cover on top of the plurality of housing walls, the fixed piston, and the second sacrificial layer;

etching the substrate to form one or more exhaust ports and one or more intake ports; and removing the first sacrificial layer to release the slider.

23. A method for forming a micro-engine, comprising the steps of:

providing a substrate having a top surface and a bottom surface;

etching the top surface of the substrate to form a plurality of housing walls and a fixed piston;

etching the substrate to form a plurality of first intake channels and a plurality of second intake channels;

providing a first sacrificial layer on top of the substrate proximate the plurality of housing walls and the fixed piston;

providing a slider on top of the first sacrificial layer;

providing a second sacrificial layer on top of the slider;

providing a cover on top of the plurality of housing walls, the fixed piston, and the second sacrificial layer;

etching the bottom surface of the substrate to form one or more exhaust ports and one or more intake ports; and removing the first sacrificial layer and the second sacrificial layer to release the slider.

* * * * *